US008760387B2

(12) United States Patent
Shimizu

(10) Patent No.: US 8,760,387 B2
(45) Date of Patent: Jun. 24, 2014

(54) DISPLAY DEVICE AND CONTROL METHOD

(75) Inventor: Masayoshi Shimizu, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 13/351,720

(22) Filed: Jan. 17, 2012

(65) Prior Publication Data

US 2012/0182335 A1 Jul. 19, 2012

Related U.S. Application Data

(63) Continuation of application No. PCT/JP2009/063180, filed on Jul. 23, 2009.

(51) Int. Cl.
*G09G 3/36* (2006.01)

(52) U.S. Cl.
USPC ..... 345/102; 345/87; 345/100; 345/690

(58) Field of Classification Search
CPC ..... F09G 3/023; G09G 3/027; G09G 3/3644; G09G 3/023; G09G 3/36; G09G 5/10; G09G 3/3651
USPC ..... 345/690, 204, 76–103
See application file for complete search history.

(56) References Cited

U.S. PATENT DOCUMENTS

| | | | | |
|---|---|---|---|---|
| 7,817,171 | B2 * | 10/2010 | Shiomi | 345/690 |
| 7,884,837 | B2 * | 2/2011 | Bing et al. | 345/690 |
| 8,199,100 | B1 * | 6/2012 | Barnhoefer | 345/102 |
| 8,368,637 | B2 | 2/2013 | Choi | |
| 2005/0184952 | A1 * | 8/2005 | Konno et al. | 345/102 |
| 2006/0120082 | A1 | 6/2006 | Choo et al. | |
| 2006/0214904 | A1 | 9/2006 | Kimura et al. | |
| 2007/0296689 | A1 | 12/2007 | Kimura et al. | |
| 2008/0111784 | A1 * | 5/2008 | Tanaka et al. | 345/102 |
| 2008/0278432 | A1 | 11/2008 | Ohshima | |
| 2009/0002308 | A1 | 1/2009 | Yoshida | |
| 2009/0009456 | A1 | 1/2009 | Ohshima | |
| 2009/0140665 | A1 | 6/2009 | Park | |
| 2009/0140975 | A1 * | 6/2009 | Nonaka et al. | 345/102 |

FOREIGN PATENT DOCUMENTS

| | | |
|---|---|---|
| JP | 2001-21863 | 1/2001 |
| JP | 2005-309338 | 11/2005 |
| JP | 2006-147573 | 6/2006 |
| JP | 2007-34251 | 2/2007 |

(Continued)

OTHER PUBLICATIONS

International Search Report for PCT/JP2009/063180 mailed Aug. 18, 2009.

(Continued)

*Primary Examiner* — Duc Dinh
(74) *Attorney, Agent, or Firm* — Staas & Halsey LLP

(57) ABSTRACT

A display device separates a size-reduced image into a plurality of sub-areas in such a manner that a sub-area farther away from the light sources becomes wider than a sub-area closer to the light sources; compares, in each of the sub-areas, the luminance values of each pixel in a direction perpendicular to the array direction; and selects a pixel having the greatest luminance value, thereby creating line information. The display device then compares a light distribution that is a synthesis of light radiation patterns of the light sources with a luminance distribution indicated by each line information and then adjusts the emission intensity of each of the light sources.

8 Claims, 13 Drawing Sheets

(56) References Cited

FOREIGN PATENT DOCUMENTS

| | | |
|---|---|---|
| JP | 2007-183499 | 7/2007 |
| JP | 2007-322881 | 12/2007 |
| JP | 2009-14746 | 1/2009 |
| JP | 2009-42652 | 2/2009 |
| JP | 2009-139470 | 6/2009 |
| JP | 2009-139910 | 6/2009 |
| JP | 2010-244013 | 10/2010 |

OTHER PUBLICATIONS

Japanese Office Action mailed Jul. 16, 2013 in corresponding Japanese Application No. 2011-523519.

* cited by examiner

FIG.7

| | 1 | 2 | 3 | ··· | 75 | 76 | 77 | 78 | 79 | 80 | 81 | ··· | 126 | 127 | 128 |
|---|---|---|---|---|---|---|---|---|---|---|---|---|---|---|---|
| 1 | 6.4 | 6.6 | 6.8 | ··· | 20.0 | 20.1 | 20.2 | 20.2 | 20.2 | 20.1 | 20.1 | ··· | 16.7 | 16.7 | 16.7 |
| 2 | 6.8 | 7.0 | 7.1 | ··· | 20.4 | 20.4 | 20.5 | 20.5 | 20.5 | 20.5 | 20.4 | ··· | 16.8 | 16.7 | 16.7 |
| 3 | 7.1 | 7.3 | 7.4 | ··· | 20.6 | 20.7 | 20.8 | 20.8 | 20.8 | 20.7 | 20.7 | ··· | 16.8 | 16.8 | 16.8 |
| 4 | 7.5 | 7.6 | 7.8 | ··· | 21.0 | 21.0 | 21.1 | 21.1 | 21.1 | 21.0 | 21.0 | ··· | 16.9 | 16.9 | 16.8 |
| 5 | 7.9 | 8.0 | 8.1 | ··· | 21.3 | 21.4 | 21.4 | 21.5 | 21.4 | 21.4 | 21.3 | ··· | 17.0 | 16.9 | 16.9 |
| 6 | 8.6 | 8.7 | 8.7 | ··· | 21.9 | 22.0 | 22.0 | 22.0 | 22.0 | 22.0 | 21.9 | ··· | 17.1 | 17.1 | 17.0 |
| 7 | 9.3 | 9.4 | 9.4 | ··· | 22.7 | 22.7 | 22.7 | 22.7 | 22.7 | 22.7 | 22.6 | ··· | 17.3 | 17.2 | 17.1 |
| ··· | ··· | ··· | ··· | ··· | ··· | ··· | ··· | ··· | ··· | ··· | ··· | ··· | ··· | ··· | ··· |
| 58 | 6.0 | 6.0 | 5.9 | ··· | 74.3 | 77.3 | 79.5 | 80.2 | 79.7 | 77.6 | 74.5 | ··· | 7.5 | 7.5 | 7.5 |
| 59 | 5.9 | 5.9 | 5.8 | ··· | 77.0 | 80.3 | 82.7 | 83.4 | 82.9 | 80.5 | 77.1 | ··· | 7.3 | 7.3 | 7.3 |
| 60 | 5.9 | 5.8 | 5.7 | ··· | 79.8 | 83.3 | 86.0 | 86.8 | 86.1 | 83.5 | 79.8 | ··· | 7.1 | 7.2 | 7.2 |
| 61 | 5.8 | 5.7 | 5.6 | ··· | 82.7 | 86.5 | 89.4 | 90.2 | 89.5 | 86.6 | 82.5 | ··· | 6.9 | 7.0 | 7.1 |
| 62 | 5.7 | 5.6 | 5.5 | ··· | 86.6 | 90.9 | 94.0 | 94.9 | 94.1 | 90.8 | 86.2 | ··· | 6.5 | 6.8 | 6.9 |
| 63 | 5.6 | 5.5 | 5.4 | ··· | 89.5 | 94.1 | 97.5 | 98.5 | 97.6 | 94.0 | 89.1 | ··· | 6.5 | 6.6 | 6.7 |
| 64 | 5.5 | 5.4 | 5.3 | ··· | 90.8 | 95.5 | 99.0 | 100.0 | 99.1 | 95.4 | 90.3 | ··· | 6.4 | 6.6 | 6.7 |

DISPLAY DEVICE AND CONTROL METHOD

CROSS-REFERENCE TO RELATED APPLICATION

This application is a continuation of International Application No. PCT/JP2009/063180, filed on Jul. 23, 2009, the entire contents of which are incorporated herein by reference.

FIELD

The embodiments discussed herein are directed to a display device, etc.

BACKGROUND

A liquid crystal display device includes a light control unit (liquid crystal panel) that can change the transmission state of light and also includes a light source (back light) that emits light toward the back surface of the light control unit. A liquid crystal display device turns on the light source and controls the transmittance of light irradiating the light control unit in accordance with the content of an image to be displayed so that a given image is displayed.

If an image to be displayed contains a black part, a liquid crystal display device sets the transmittance of light irradiating the black part to the lowest possible level; however, a light control unit does not block the amount of light emitted from the light source entirely. Therefore, a liquid crystal display device does not decrease the luminance of a black part to a value sufficiently low level and the contrast of a displayed image is decreased. Moreover, because a back light always irradiates with a luminance maintained at the same level, a large amount of power is consumed lighting the back light.

A technology that prevents a decrease in the contrast involves arranging multiple light sources on the back surface of a light control unit in a grid in such a manner that areas irradiated by their respective light sources are independent from each other and controlling the emission intensity of each of the light sources is in accordance with the image to be displayed (Japanese Laid-open Patent Publication No. 2005-258403 and Japanese Laid-open Patent Publication No. 2006-147573).

SUMMARY

According to an aspect of an embodiment of the invention, a display device includes a plurality of light sources that are aligned in a first direction in such a manner that areas irradiated by the light sources overlap with each other; an image display area that includes a first pixel and a second pixel, the first pixel and the second being aligned in a second direction that makes an angle with the first direction; a comparing unit that compares a first luminance, which is a luminance of an image to be displayed at a first position of the first pixel, with a second luminance, which is a luminance of the image to be displayed at a second position of the second pixel; and a control unit that controls an amount of light from each of the light sources in accordance with a comparison result acquired by the comparing unit.

The object and advantages of the embodiment will be realized and attained by means of the elements and combinations particularly pointed out in the claims.

It is to be understood that both the foregoing general description and the following detailed description are exemplary and explanatory and are not restrictive of the embodiment, as claimed.

BRIEF DESCRIPTION OF DRAWINGS

FIG. 7 is a table of an example of the light radiation pattern;

DESCRIPTION OF EMBODIMENTS

Figure 1:
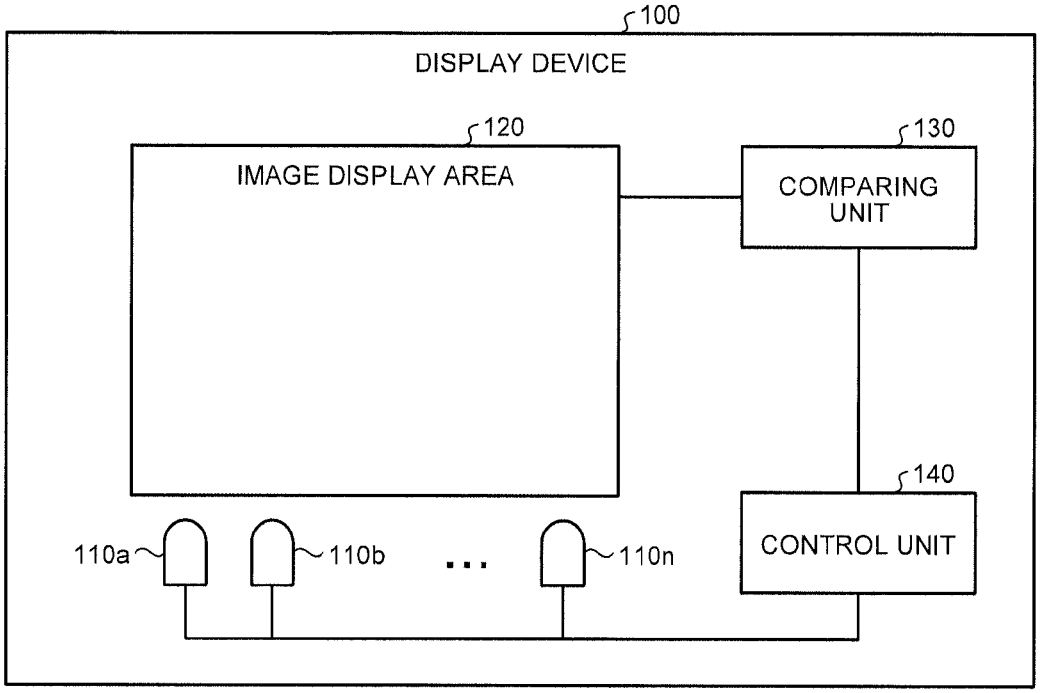
FIG. 1 is a block diagram of the configuration of a display device according to a first embodiment of the present invention.

Preferred embodiments of the present invention will be explained with reference to accompanying drawings.

The present invention is not limited to the following embodiments. It is allowable to combine any of the embodiments unless the contents of the processes are inconsistent.

According to the above technology, if, for example, an image to be displayed contains a black part, the intensity of light irradiating the black part is decreased, and thereby the amount of light transmitted through the light control unit is decreased, which means that eventually the luminance of the black part is decreased. Because, according to the above conventional technology, an area irradiated by each of the light sources that are arranged in a grid manner is defined, it is possible to set the emission intensity of each of the light sources in accordance with the content of an image displayed on the corresponding irradiated area. When these kind of light sources are used, the emission intensity of each of the light sources is easily calculated. However, depending on the assembly accuracy of a display device and the individual variability among light sources, unevenness in the brightness of an image to be displayed is noticeable.

Therefore, a display device in which areas irradiated by respective light sources are independent from each other is assembled with high accuracy and it is preferably to adjust the emission intensity of each of the light sources, the display device being costly.

In response to this drawback, there is a display device that has multiple light sources arranged such that irradiated areas overlap with each other rather than having each light source for an irradiated area being separate. Because the areas irradiated by the light sources are not independent from each other, even if the assembly accuracy of a display device is low or the adjustment accuracy of the emission intensity of each light source is low, unevenness in brightness is difficult to notice. A display device that has multiple light sources arranged such that irradiated areas overlap with each other has an advantage in that production costs are reduced when compared with a display device in which areas irradiated by their respective light sources are independent from each other.

A liquid crystal display device that that has multiple light sources arranged such that irradiated areas overlap with each other does not clearly define the irradiated areas independently on the light-source basis; therefore, it does not accurately control the emission intensity of each of the light sources in accordance with an image to be displayed. In other words, it is difficult to improve the contrast of a liquid crystal display device that has multiple light sources arranged such that irradiated areas overlap with each other.

Important problems to be solved with a liquid crystal display device that has light sources being arranged in a manner that gives production cost advantages are to increase the contrast and to reduce the consumed power.

[a] First Embodiment

A prior invention invented by the same inventor(s) will be explained before the explanation of a first embodiment of the present invention. The following prior technology does not correspond to a conventional technology.

The prior invention achieves an increase of the contrast and a reduction of the power consumption by a following control over a display device that includes light sources that emit broad light. Firstly, a display device according to the prior invention sets the emission intensity of each light source to a predetermined value and calculates a light distribution in accordance with a light radiation pattern of each light source at the emission intensity. In the following, a light distribution that is a synthesis of distributions of light from respective light sources is called "synthesized light distribution".

Subsequently, the display device compares a line-by-line luminance distribution of an image to be displayed with the synthesized light distribution and controls the emission intensity of each of the light sources so that the synthesized light distribution does not go under the luminance distribution of each line.

Figure 17:
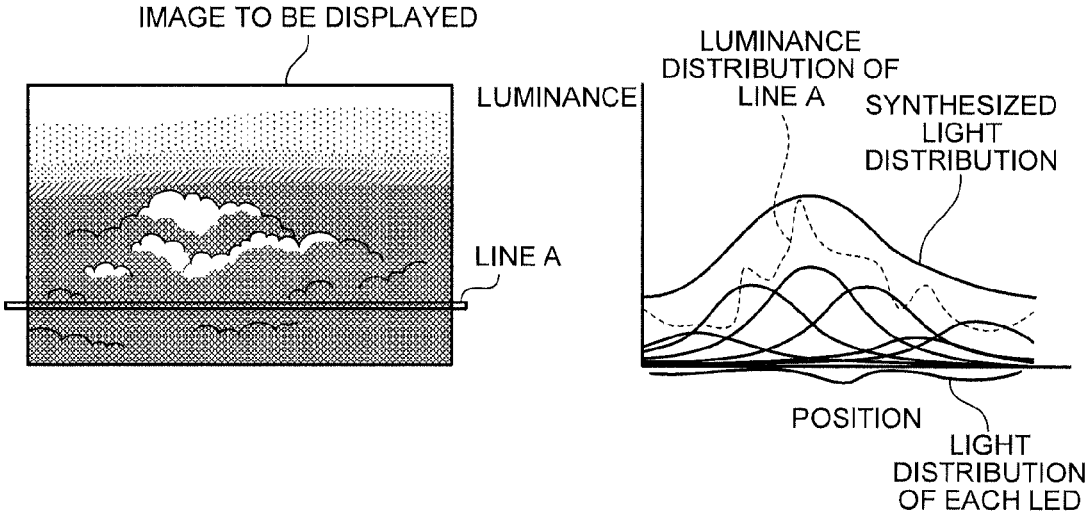
FIG. 17 is a diagram that illustrates an emission intensity control according to the prior technology.

FIG. 17 is a diagram that illustrates an emission intensity control according to the prior technology. For example, the display device compares the luminance distribution of a line A with the synthesized light distribution and adjusts each of the light sources so that the synthesized light distribution does not go under the luminance distribution of the line A. The display device performs the same process with another line and decides the emission intensity of each of the light sources.

As described above, according to the prior invention, the luminance distribution is compared with the synthesized light distribution sequentially line by line, the emission intensity of each light source is decided so that the synthesized light distribution does not go under the luminance distribution of each line, and the emission intensity of each light source is thus controlled; therefore, even if the light radiation patterns overlap with each other, the amount of light irradiating a black part of an image to be displayed is decreased and the contrast is improved.

However, according to the above prior invention, the display device needs to perform the same number of repetitions as the number of lines of the comparing the luminance distribution with the synthesized light distribution and the adjusting the emission intensity of each light source.

The prior invention can be modified by, for example, decreasing the number of lines to be compared, thereby decreasing the amount of calculation. However, if the number of lines to be compared is decreased simply, the accuracy of adjustment of the emission intensity of each light source is reduced for the decreased amount of calculation and, depending on circumstances, the contrast may be decreased.

The configuration of a display device will be explained according to the first embodiment of the present invention. FIG. 1 is a block diagram of the configuration of a display device 100 according to the first embodiment of the present invention. As illustrated in FIG. 1, the display device 100 includes light sources 110*a* to 110*n*, an image display area 120, a comparing unit 130, and a control unit 140.

The light sources 110*a* to 110*n* have display areas of the image display area 120 overlapping with each other. Although, for the convenience of a simple explanation, the light sources 110*a* to 110*n* are illustrated, the display device 100 has some other light sources. The light sources can be, for example, LEDs (Light Emitting Diodes).

The image display area 120 includes a first pixel and a second pixel. The comparing unit 130 is a processing unit that compares a first luminance, which is the luminance of a pixel included in an image to be displayed that corresponds to a first pixel position included in the image display area 120, with a second luminance, which is the luminance of a pixel included in the image to be displayed that corresponds to a second pixel position. Moreover, the first pixel and the second pixel can be aligned in a direction that makes an angle with an array direction of the light sources. The direction that makes an angle can be, for example, a direction perpendicular to the array direction of the light sources.

The control unit 140 is a processing unit that controls the amount of light from the light sources 110*a* to 110*n* in accordance with a comparison result made by the comparing unit 130. The control unit 140 controls the amount of light from each of the light sources in accordance with a greater luminance of either the first luminance or the second luminance.

As described above, in the display device 100 of the first embodiment, the comparing unit 130 compares the first luminance, which is the luminance of a pixel included in an image to be displayed that corresponds to the first pixel position included in the image display area 120, with the second luminance, which is the luminance of a pixel included in the image to be displayed that corresponds to the second pixel position. The control unit 140 controls the amount of light from each of the light sources 110*a* to 110*n* in accordance with a comparison result made by the comparing unit 130. Accordingly, a decrease of the contrast is prevented while the cost for the liquid crystal display device is suppressed.

With the abovementioned configuration, even a liquid crystal display device that includes light sources being arranged in a manner advantageous in the cost achieves both an increase of the contrast and a reduction of the consumed power. The amount of calculation is also decreased.

[b] Second Embodiment

Figure 2:
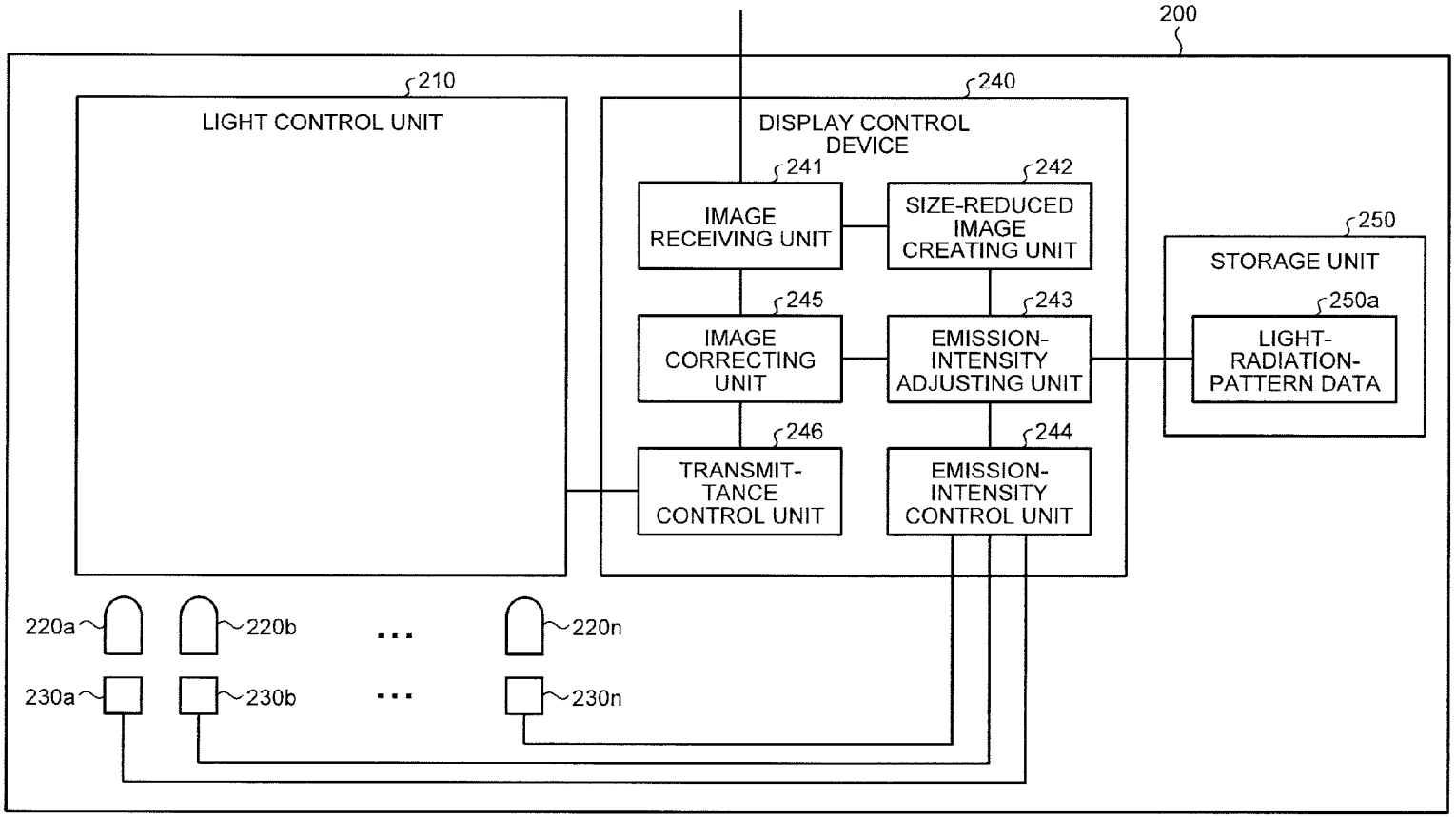
FIG. 2 is a block diagram of the configuration of a display device according to a second embodiment of the present invention.

The configuration of a display device will be explained below according to a second embodiment of the present invention. FIG. 2 is a block diagram of the configuration of a display device according to the second embodiment of the present invention. As illustrated in FIG. 2, a display device 200 includes a light control unit 210, light sources 220*a* to 220*n*, drivers 230*a* to 230*n*, a display control device 240, and a storage unit 250.

The light control unit 210 is, for example, a liquid crystal panel and changes the transmittance of light depending on each pixel. The light sources 220*a* to 220*n* are, for example, LEDs that emit light toward the light control unit 210 from the back surface. In the display device 200, the light sources 220*a* to 220*n* are arranged on the back surface of the light control unit 210 not in a grid manner but in one line along a side of the light control unit 210 (a lower side in the example illustrated FIG. 2). Because the light sources 220*a* to 220*n* are arranged in one line as described above, when a plurality of light sources are irradiating, substantially the same luminance is obtained over the entire area. Moreover, it is possible to reduce the number of the light sources 220 and, thereby, reduce the cost for the components.

Figure 3:
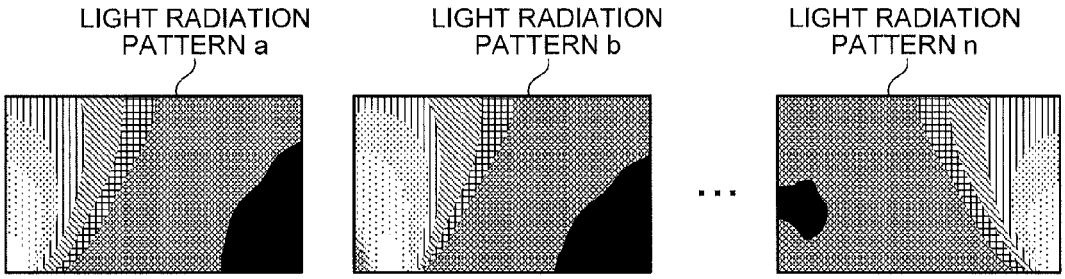
FIG. 3 is a schematic diagram of light radiation patterns of some light sources.

A light radiation pattern of each light source will be explained below. FIG. 3 is a schematic diagram of light radiation patterns of some light sources. A light radiation pattern a of FIG. 3 is a light radiation pattern of the light source 220*a* that is at the left end of the light control unit 210. A light radiation pattern b of FIG. 3 is a light radiation pattern of the light source 220*b* that is on the right side of the light source 220*a*. The light radiation pattern n of FIG. 3 is a light radiation pattern of the light source 220*n* that is at the right end of the light control unit 210.

As illustrated in FIG. 3, the light radiation pattern of each of the light sources 220 becomes wider as it goes away from each of the light sources 220. The light radiation pattern of a given light source of the light sources 220 overlaps with the light radiation patterns of some light sources of the light sources 220.

Referring back to FIG. 2, the drivers 230*a* to 230*n* drive the light sources 220*a* to 220*n*, respectively in accordance with a control amount specified by the display control device. Although, in the example illustrated in FIG. 2, the light sources 220 correspond to the drivers 230 on a one-on-one basis, one driver of the drivers 230 can be configured to drive some light sources of the light sources 220.

The display control device 240 is a control circuit that controls the light control unit 210 and the drivers 230*a* to 230*n*. The display control device 240 includes an image receiving unit 241, a size-reduced image creating unit 242, an emission-intensity adjusting unit 243, an emission-intensity control unit 244, an image correcting unit 245, and a transmittance control unit 246.

The image receiving unit 241 is a processing unit that receives an image to be displayed and then temporarily stores therein the received input image. Suppose, for example, the size of a received image is 800×400. The size-reduced image creating unit 242 is a processing unit that creates a size-reduced image of an input image received by the image receiving unit 241. Although, in this example, a size-reduced image are subjected to subsequent processes for processing-time saving, it is allowable to process an input image remaining as it is.

A size-reduced image creating process performed by the size-reduced image creating unit 242 will be explained below. The size-reduced image creating unit 242 refers to RGB (Red, Green, and Blue) values assigned to a pixel of an input image and selects the greatest value among the R value, the G value, and the B value. The size-reduced image creating unit 242 then sets the greatest value to the luminance value that corresponds to the pixel.

If, for example, RGB values assigned to a first pixel are (250, 100, 50), respectively, then the greatest value is 250. The size-reduced image creating unit 242 sets the luminance value of the first pixel to 250. The size-reduced image creating unit 242 performs the above process with all the pixels included in the input image. When the above process is performed, each pixel included in the input image has one luminance value assigned thereto. It is allowable to convert the greatest value selected from the R value, the G value, and the B value (pixel value) into the luminance value by using the following equation (1).

Subsequently, the size-reduced image creating unit 242 extracts some from the input image having the size 800×400, thereby creating a size-reduced image having the size 200×100. Each pixel of the size-reduced image has the abovementioned luminance value assigned thereto. The size-reduced image creating unit 242 can be configured to create a size-reduced image by using some other methods such as a bilinear interpolation.

The emission-intensity adjusting unit 243 is a processing unit that adjusts, in accordance with light-radiation-pattern data 250*a* stored in the storage unit 250, the emission intensity of each of the light sources 220 so that, a corrected size-reduced image is displayed with a just enough intensity of light. The configuration of the emission-intensity adjusting unit 243 and the process performed by the emission-intensity adjusting unit 243 will be explained in detail later.

The emission-intensity control unit 244 is a processing unit that gives a control amount to each of the drivers 230 depending on an adjustment result made by the emission-intensity adjusting unit 243 and causes each of the light sources 220 to emits light with an intensity depending on the adjustment result made by the emission-intensity adjusting unit 243.

The image correcting unit 245 is a processing unit that corrects each pixel of an input image in accordance with a rate of change in the amount of light irradiating the corresponding pixel of the light control unit 210 based on adjustment of the emission-intensity adjusting unit 243. More particularly, because widely used settings have the proportional relation between the luminance and the pixel value that is calculated as follows:

$$\text{Luminance} \propto (\text{pixel value}\hat{}2.2) \quad (1)$$

the image correcting unit 245 calculates an after-correction pixel value by using Equation (2).

$$\text{After-correction pixel value} = \text{before-correction pixel value} \times (1/\text{fading rate})\hat{}(1/2.2) \quad (2)$$

The transmittance control unit 246 is a processing unit that controls the transmittance of each pixel of the light control unit 210 in accordance with a corresponding pixel of an input image that is corrected by the image correcting unit 245. The storage unit 250 stores therein information, used for operations of the display control device 240. For example, the storage unit 250 stores the light-radiation-pattern data 250*a*.

Figure 4:
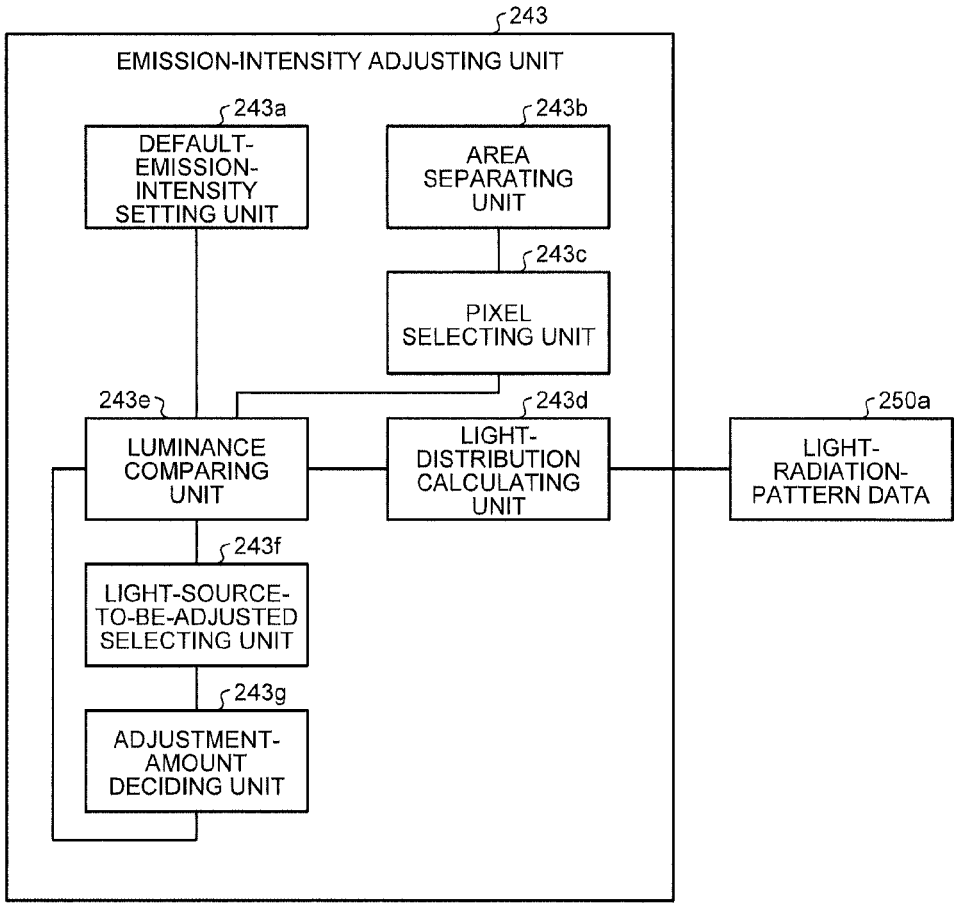
FIG. 4 is a block diagram of the configuration of the emission-intensity adjusting unit.

The configuration of the emission-intensity adjusting unit 243 illustrated in FIG. 2 will be explained in detail below. FIG. 4 is a block diagram of the configuration of the emission-intensity adjusting unit 243. As illustrated in FIG. 4, the emission-intensity adjusting unit 243 includes a default-emission-intensity setting unit 243*a*, an area separating unit 243*b*, a pixel selecting unit 243*c*, a light-distribution calculating unit 243*d*, a luminance comparing unit 243*e*, a light-source-to-be-adjusted selecting unit 243*f*, and an adjustment-amount deciding unit 243*g*.

The default-emission-intensity setting unit 243*a* is a processing unit that decides a default value of the emission intensity of each of the light sources 220 depending on an input image. More particularly, the default-emission-intensity setting unit 243*a* sets an actual emission intensity of each of the light sources 220 that corresponds to a previously displayed input image to the default value of each of the light sources 220 that corresponds to a newly received input image. Because, in most cases, input images that are received sequentially are similar to each other, if, as described above, a previous adjustment result is set to the default value, an adjustment amount is decreased and the adjustment will be completed quickly. When an input image is the first image, a predetermined emission intensity is set to the default value. Moreover, because a current adjustment result is expected to be similar to a previous adjustment result, troubles are prevented, such as a flicker appearing on the light control unit 210 due to a change of adjustment contents on an input-image basis.

If it is needed to decrease the emission intensity of each of the light sources 220 to the lowest possibly, it is allowable to set the default value of the emission intensity of each of the light sources 220 to a value a predetermined amount less than the actual emission intensity of each of the light sources 220 that corresponds to the previously displayed input image. If the default value is set in the above manner, when a later-described emission-intensity adjusting process is performed, the emission intensity of each of the light sources 220 is set to a value lowest possibly but sufficient to display a size-reduced image. If the process is needed to be simplified, it is allowable to set the default value of the emission intensity of each of the light sources 220 to a value about 90% of the maximum value.

Figure 5:
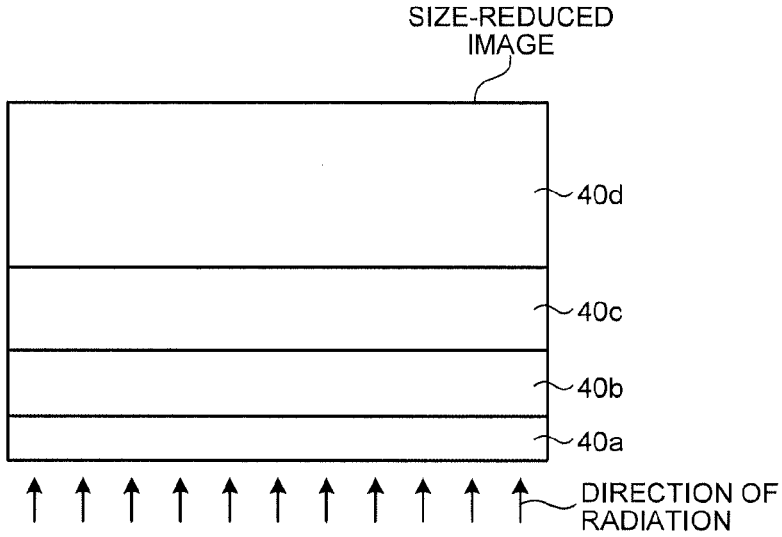
FIG. 5 is a diagram that illustrates an example of sub-areas of a size-reduced image.

The area separating unit 243*b* is a processing unit that separates a size-reduced image into a plurality of sub-areas each defined by a line perpendicular to a direction of radiation. The direction of radiation is, herein, a direction in which light from the light sources 220 enters when an input image that corresponds to a size-reduced image is displayed on the light control unit 210. FIG. 5 is a diagram that illustrates an example of sub-areas of a size-reduced image.

As illustrated in FIG. 5, the area separating unit 243*b* separates the area of a size-reduced image into sub-areas 40*a* to 40*d* in such a manner that a sub-area farther away from the light sources 220 is wider than a sub-area closer to the light sources 220. For example, the ratio between the widths of the sub-areas is 8:4:3:2 from the top. Although, in this example, the area separating unit 243*b* separates a size-reduced image into the sub-areas 40*a* to 40*d*, the separation manner is not limited thereto.

The pixel selecting unit 243*c* compares, in each of the sub-areas, the luminance values of each pixel included in those in a direction perpendicular to the array direction and selects a pixel having the greatest luminance value, thereby creating line information. Line information is, herein, data that contains a collection of greatest luminance values within a sub-area being aligned in the array direction. The array direction is the direction in which the light sources 220 is aligned and the array direction is perpendicular to the above-mentioned direction of radiation.

Figure 6:
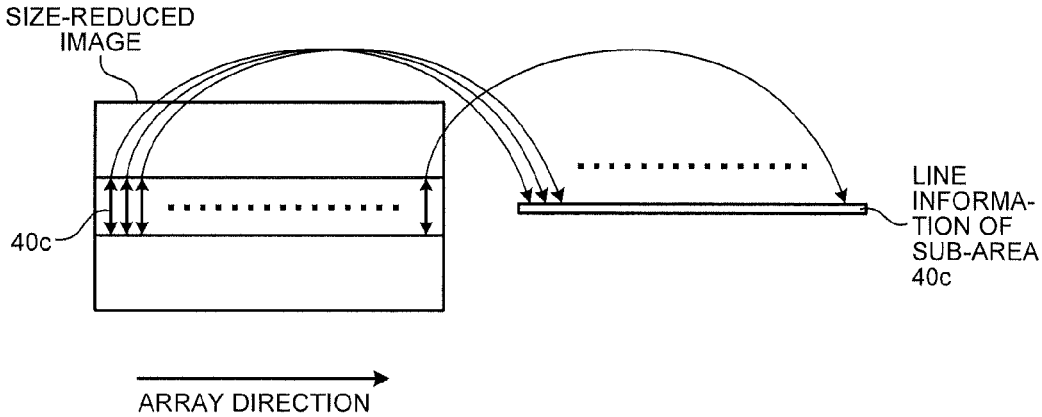
FIG. 6 is a diagram that explains a process performed by the pixel selecting unit.

FIG. 6 is a diagram that explains a process performed by the pixel selecting unit 243*c*. The process will be explained with reference to FIG. 6 with an example of creating line information using the sub-area 40*c*. Firstly, the pixel selecting unit 243*c* sets the left-sided pixels of the sub-area 40*c* to be reference pixels, compares the luminance values of each pixel in a perpendicular direction of the sub-area 40*c*, and selects a pixel having the greatest luminance value. The pixel selecting unit 243*c* sets the luminance value of the selected pixel to the luminance value of the left-sided pixel in line information.

Subsequently, the pixel selecting unit 243*c* sets n-th pixels of the sub-area 40*c* from the left (n is a natural number) to be reference pixels, compares the luminance values of each pixel in a perpendicular direction of the sub-area 40*c*, and selects a pixel having the greatest luminance value. The pixel selecting unit 243*c* sets the luminance value of the selected pixel to the luminance value of the n-th pixel from the left. As described above, the pixel selecting unit 243*c* repeats the above process from the left side to the right side of the sub-area 40*c*, thereby creating line information using the sub-area 40*c*. The pixel selecting unit 243*c* creates line information using the other sub-areas 40*a*, 40*b*, and 40*d* in the same manner.

The light-distribution calculating unit 243*d* is a processing unit that calculates, in accordance with the light-radiation-pattern data 250*a*, a light distribution that is a synthesis of distributions of light emitted from all the light sources 220.

The light-radiation-pattern data 250*a* will be explained below. FIG. 7 is a table of an example of the light radiation pattern. FIG. 7 illustrates an example of the light radiation pattern of a light source that is, when the light control unit 210 is separated into 64 columns×128 rows and the 24 light sources 220 are aligned in one line, the tenth light source 220 from the right. The unit of each value is cd/m$^2$.

Figure 8:
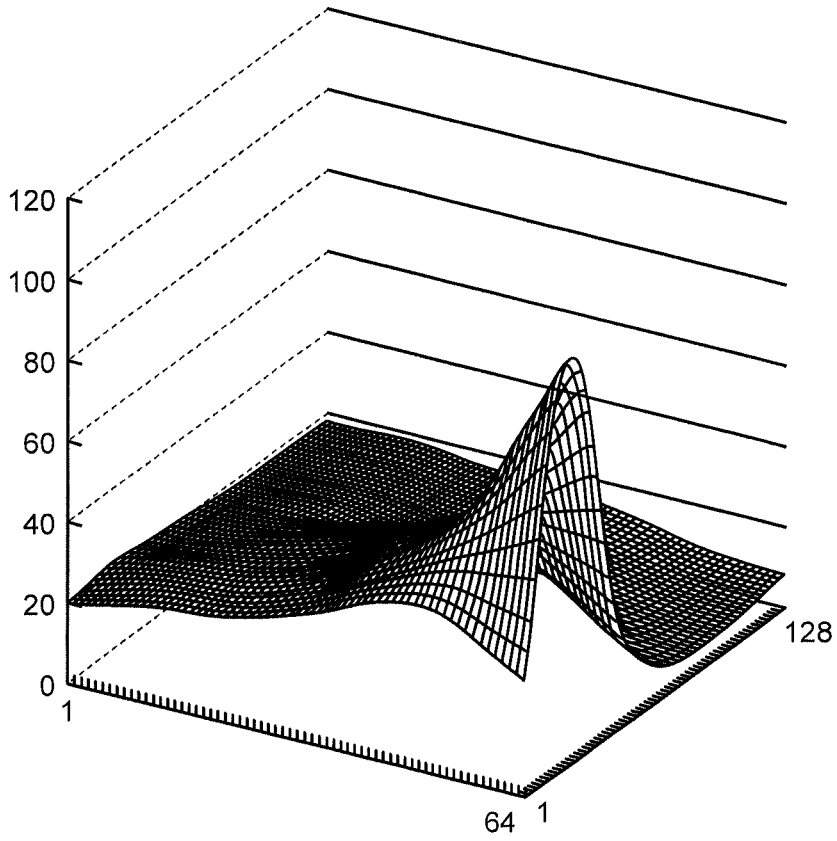
FIG. 8 is a 3D graph of the light radiation pattern illustrated in FIG. 7.

FIG. 8 is a 3D graph of the light radiation pattern illustrated in FIG. 7. As illustrated in FIGS. 7 and 8, the light-radiation-pattern data 250*a* contains information indicative of the luminance of light irradiating each section of the light control unit 210 when the corresponding light source 220 irradiates at the 100% intensity.

The light-distribution calculating unit 243*d* multiplies the light radiation pattern of each of the light sources 220 included in the light-radiation-pattern data 250*a* by the emission intensity of the light source 220, thereby calculating the luminance on the light control unit 210 when each of the light sources 220 irradiates solely. The light-distribution calculating unit 243*d* then calculates the sum of the calculated luminances on the section of the light control unit 210 basis, thereby calculating a light distribution that corresponds to a situation when all the light sources 220 are irradiating at the respective emission intensities.

The luminance comparing unit 243*e* is a processing unit that compares a luminance distribution indicated by line information that is created by the pixel selecting unit 243*c* with the light distribution. The luminance comparing unit 243*e* identifies positions that correspond to positions in the middle of the sub-area 40*a* with respect to the direction perpendicular to the array direction of the light sources. The luminance comparing unit 243*e* then compares the light distribution at the identified position with the luminance distribution indicated by the line information assigned to the sub-area 40*a*. The comparing is performed in the same manner with the line information assigned to another sub-area.

Figure 9:
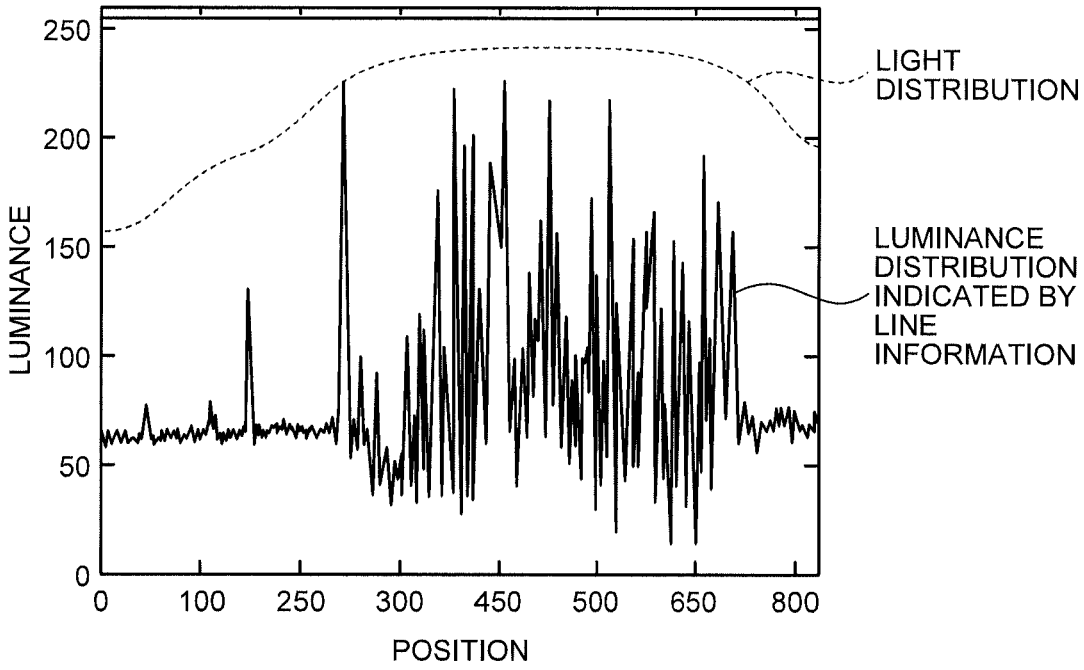
FIG. 9 is a graph of a luminance distribution indicated by line information and a light distribution.

FIG. 9 is a graph of the luminance distribution indicated by the line information and the light distribution. The luminance distribution indicated by the solid line of FIG. 9 indicates a distribution of the luminance values of pixels that are obtained when the line information that is created using the sub-area 40*a* is scanned in the array direction. The light distribution indicated by the doted line of FIG. 9 indicates a light distribution of the luminance values at positions that correspond to positions in the middle of the sub-area 40*a*.

The luminance comparing unit 243*e* compares the light distribution with the luminance distribution indicated by the line information position by position in the array direction. If any part is found in which the luminance of the light distribution is under the luminance value of the line information, the luminance comparing unit 243*e* causes the light-source-to-be-adjusted selecting unit 243*f* to select a light source to be adjusted from the light sources 220. After that, the adjustment-amount deciding unit 243*g* decides an increased amount of the emission intensity of the selected light source 220.

The luminance comparing unit 243*e* compares the light distribution with the luminance distribution indicated by the line information position by position in the array direction. If no part is found in which the luminance of the light distribution is under the luminance value of the line information, the luminance comparing unit 243*e* causes the light-source-to-be-adjusted selecting unit 243*f* to select a light source that is allowed to decrease the emission intensity from the light sources 220. When a light source that is allowed to decrease the emission intensity is selected from the light sources 220, the adjustment-amount deciding unit 243*g* decides a decreased amount of the emission intensity of the selected light source 220.

After the emission intensity of the light source 220 selected by the light-source-to-be-adjusted selecting unit 243*f* is adjusted, the light-distribution calculating unit 243*d* creates a new light distribution reflecting the adjustment result of the emission intensity. The luminance comparing unit 243*e* then compares the new light distribution with the luminance distribution indicated by the line information. If any light source is found that has an adjustable emission intensity in the light sources 220, the emission intensity of the light source 220 is adjusted and a new light distribution is created. The above process is repeated until no light source is found that has an adjustable emission intensity in the light sources 220.

When no light source is found that has an adjustable emission intensity in the light sources 220, the same process is performed to adjust the line information assigned to an adjacent sub-area. When, eventually, the line information of every sub-area is checked and no light source is found that has an adjustable emission intensity in the light sources 220, the emission-intensity adjusting process is then completed. When the 2-nd or subsequent line information is checked, the selecting of any light source that is allowed to decrease the emission intensity from the light sources 220 is not performed. This is because, when the emission intensity is decreased using the 2-nd or subsequent line information (line information assigned to any of the sub-areas 40*b* to 40*d*) after the adjustment using the sub-area 40*a*, there is the possibility that the amount of light irradiating the sub-area 40*a* is decreased to a value insufficient to display the size-reduced image.

Figure 10:
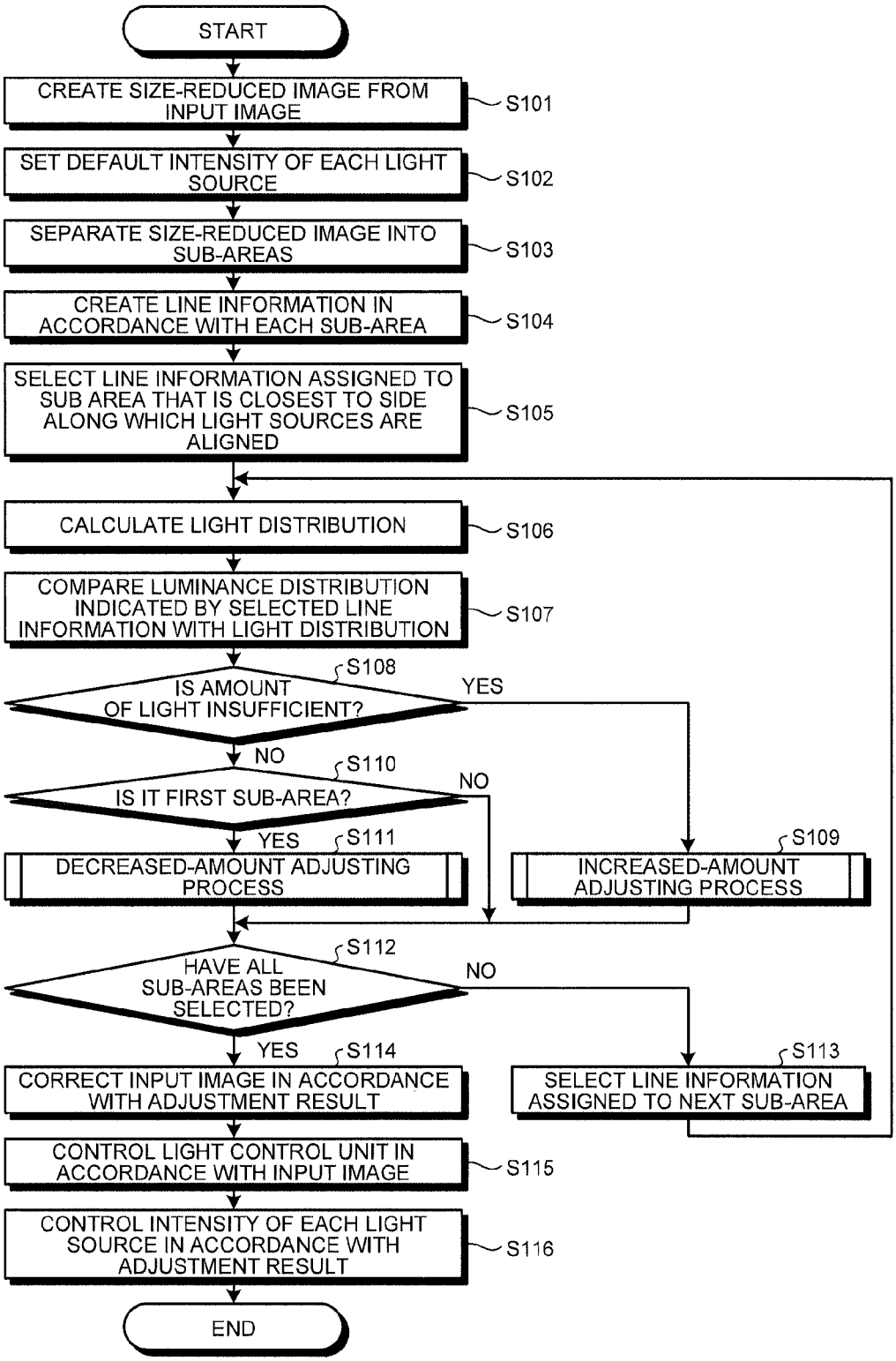
FIG. 10 is a flowchart of an emission-intensity adjusting process.

The emission-intensity adjusting process will be explained below. FIG. 10 is a flowchart of an emission-intensity adjusting process. As illustrated in FIG. 10, the size-reduced image creating unit 242 creates a size-reduced image from an input image (S101). The default-emission-intensity setting unit 243*a* then sets the default value of the emission intensity of each of the light sources 220 (S102).

The area separating unit 243*b* separates the size-reduced image into sub-areas (S103), and the pixel selecting unit 243*c* creates line information in accordance with each sub-area (S104). Subsequently, the emission-intensity adjusting unit 243 selects line information assigned to a sub-area that is closest to the upstream side in the direction of radiation among the subareas, i.e., line information assigned to a sub-area that is closest to the side along which the light sources 220 are aligned in an displaying mode as a sub-area to be adjusted (S105).

The light-distribution calculating unit 243*d* calculates a light distribution (S106), and the luminance comparing unit 243*e* compares the luminance distribution indicated by the selected line information with the luminance of the corresponding part of the light distribution (S107). If any part is found that has an insufficient amount of light (Yes at S108), a later-described increased-amount adjusting process is performed (S109).

On the other hand, if no part is found that has an insufficient amount of light (No at 5108) and if the sub-area that corresponds to the selected line information is the first sub-area (Yes at S110), a later-described decreased-amount adjusting process is performed (S111). If the sub-area that corresponds to the selected line information is the second or subsequent sub-area (No at S110), the decreased-amount adjusting process is not performed.

When the process using the line information to be adjusted is completed, if all the sub-areas have not been selected for adjustment of the line information (No at S112), the line information assigned to a next sub-area is then selected (S113), and the process is repeated from S106.

On the other hand, if all the sub-areas have been selected for adjustment of the line information (Yes at S112), the image correcting unit 245 corrects the image in accordance with the adjustment result (S114). The transmittance control unit 246 then controls the transmittance of each pixel of the light control unit 210 in accordance with the corrected input image (S115). Subsequently, the emission-intensity control unit 244 controls the emission intensity of each of the light sources 220 in accordance with the adjustment result (S116).

Figure 11:
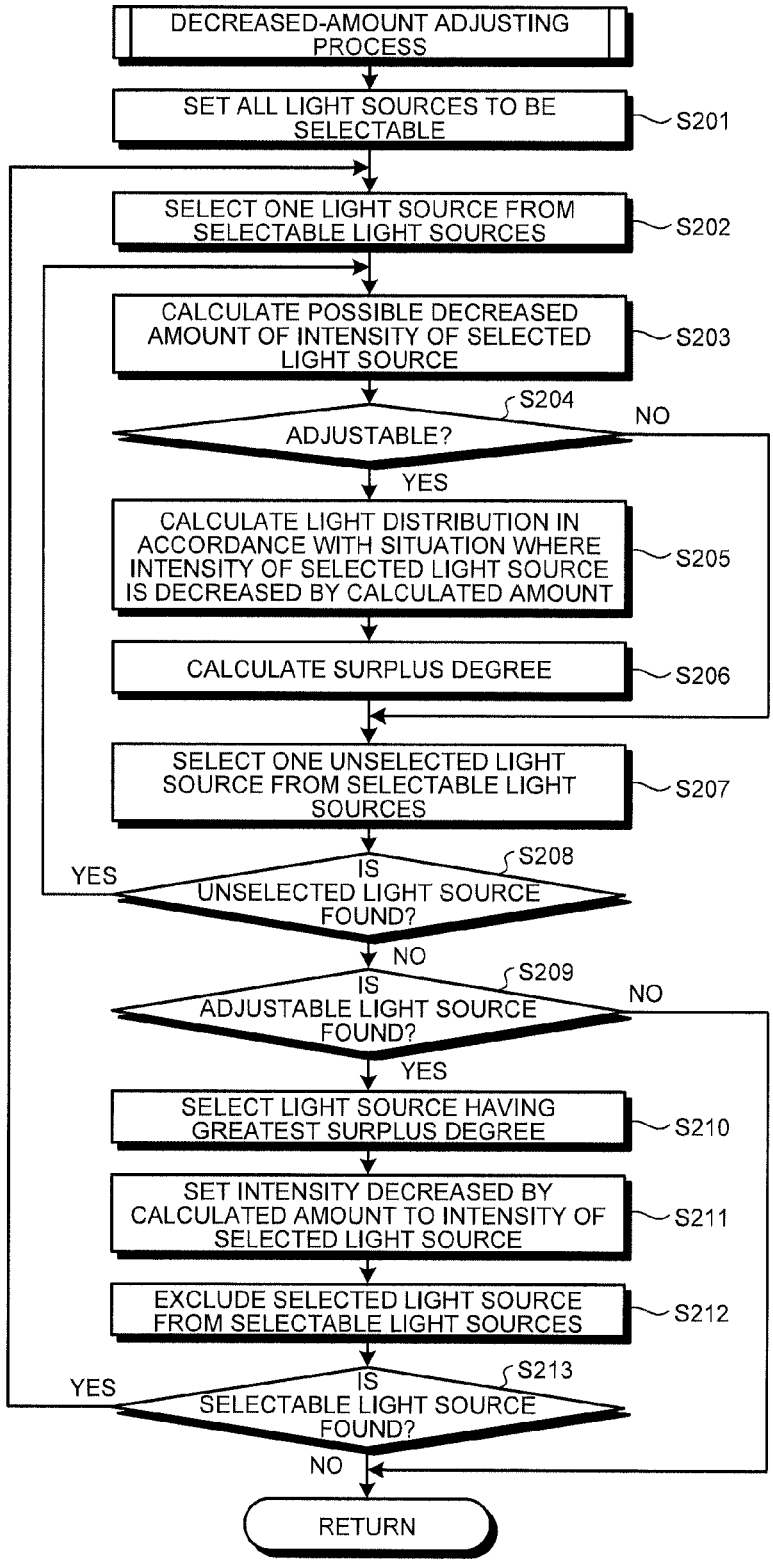
FIG. 11 is a flowchart of a decreased-amount adjusting process.

The decreased-amount adjusting process that is performed at 5111 of FIG. 10 will be explained in detail below. FIG. 11 is a flowchart of the decreased-amount adjusting process. As illustrated in FIG. 11, the emission-intensity adjusting unit 243 sets all the light sources 220 to be selectable (S201). The emission-intensity adjusting unit 243 then selects one light source from the selectable light sources 220 (S202). Subsequently, the adjustment-amount deciding unit 243*g* calculates a possible decreased amount of the emission intensity of the selected light sources 220 for maintaining a sufficient amount of light (S203).

The emission-intensity adjusting unit 243 can limit the decreased amount of the emission intensity to, for example, 30% or less. When the amount of light is decreased greatly, the difference becomes large between brightnesses of images that are displayed sequentially and a problem may occur, such as a flicker.

If the selected light source is allowed to decrease the emission intensity (Yes at S204), the light-distribution calculating unit 243*d* calculates a light distribution in accordance with a situation where the emission intensity of the selected light source 220 is decreased by the calculated amount (S205). The adjustment-amount deciding unit 243*g* then calculates, in accordance with the calculated light distribution, the sum of possible decreased amounts of any other light sources 220 for maintaining a sufficient amount of light, thereby calculating the surplus degree (S206).

On the other hand, if the selected light source 220 is not allowed to decrease the emission intensity (No at S204), the surplus degree is not calculated.

Subsequently, the emission-intensity adjusting unit 243 selects one unselected light source from the selectable light sources 220 (S207). When an unselected light source is selected from the light sources 220 (Yes at S208), the process is repeated from S203.

On the other hand, when no unselected light source is found in the light sources 220, i.e., all the selectable light sources 220 have been checked already (No at S208), the emission-intensity adjusting unit 243 checks whether any light source is found in the light sources 220 that is allowed to decrease the emission intensity (S209). If no light source is found in the light sources 220 that is allowed to decrease the emission intensity (No at S209), the decreased-amount adjusting process goes to end.

On the other hand, if any light source is found in the light sources 220 that is allowed to decrease the emission intensity (Yes at S209), the light-source-to-be-adjusted selecting unit 243*f* selects a light source having the greatest surplus degree from the light sources 220 as a light source to be adjusted (S210). The adjustment-amount deciding unit 243*g* then sets an emission intensity decreased by the calculated decreased amount to the emission intensity of the selected light source 220 (S211). The emission-intensity adjusting unit 243 then excludes the selected light source 220 from the selectable light sources (S212), and if any light source is present in the selectable light sources 220 (Yes at S213), the process is repeated from S202. If no light source is present (No at S213), the decreased-amount adjusting process goes to end.

Although, in the above process, in order to increase the total decreased amount, the decreasing of the emission intensity of the light sources 220 is performed in the descending order according to the surplus degree, it is allowable, for simplicity of the process, to perform the decreasing of the emission intensity of the light sources 220 in the descending order according to the possible decreased amount of the emission intensity. To prevent a problem, such as unevenness in the luminance, it is allowable to adjust the difference between decreased amounts of the emission intensities of adjacent light sources of the light sources 220 to a predetermined amount or less.

Figure 12:
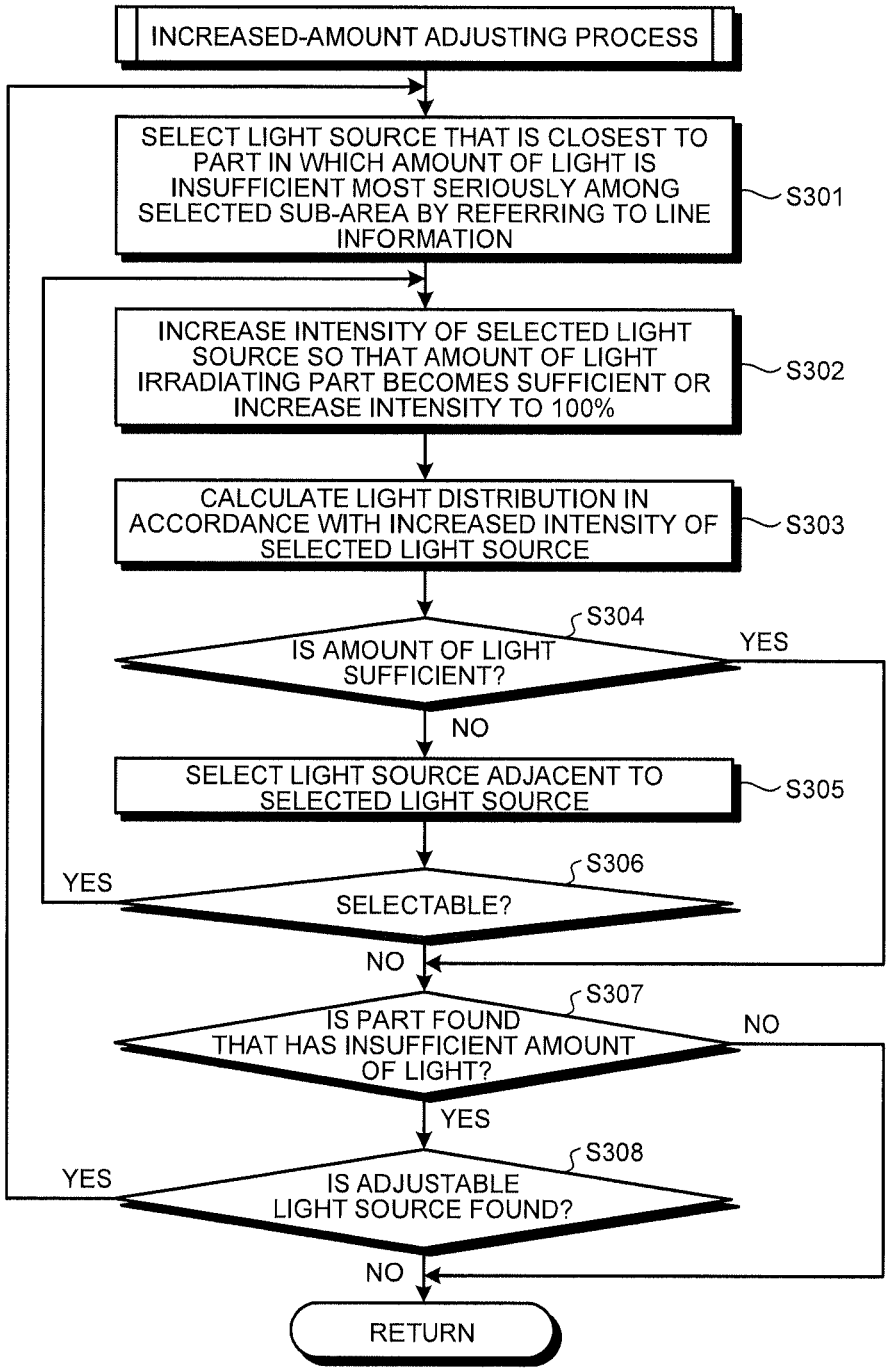
FIG. 12 is a flowchart of an increased-amount adjusting process.

The increased-amount adjusting process that performed is at S109 of FIG. 10 will be explained in detail below. FIG. 12 is a flowchart of the increased-amount adjusting process. As illustrated in FIG. 12, the luminance comparing unit 243*e* finds, by referring to the line information assigned to a selected sub-area to be adjusted, a part in which the amount of light is insufficient most seriously. The light-source-to-be-adjusted selecting unit 243*f* then selects a light source that is closest to the part from the light sources 220 as a light source to be adjusted (S301).

Figure 13:
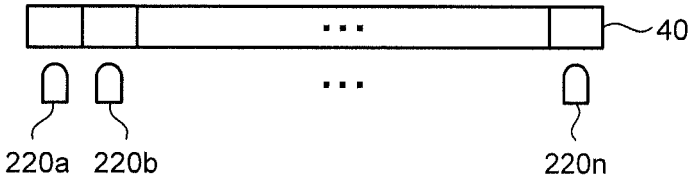
FIG. 13 is a diagram that illustrates an example of the way of separating a sub-area to facilitate selecting a light source that is closest to a part in which the amount of light is insufficient most seriously.

The selection from the light sources 220 of a light source that is closest to a part in which the amount of light is insufficient most seriously can be performed easily when the selected sub-area to be adjusted is separated into the same number of areas as the number of the light sources 220 as illustrated in FIG. 13. FIG. 13 is a diagram that illustrates an example of the way of separating a sub-area to facilitate selecting a light source that is closest to a part in which the amount of light is insufficient most seriously.

The adjustment-amount deciding unit 243*g* increases the emission intensity of the selected light source 220 to be adjusted so that the amount of light irradiating the part becomes sufficient or increases the emission intensity to 100% (S302). Subsequently, the light-distribution calculating unit 243*d* calculates a light distribution in accordance with the increased emission intensity of the light source 220 that is selected as a light source to be adjusted (S303).

The luminance comparing unit 243*e* determines whether the amount of light irradiating the part is sufficient. If the amount of light is still insufficient (No at S304), the light-source-to-be-adjusted selecting unit 243*f* selects, from the light sources 220, a light source adjacent to the light source 220 that is selected as a light source to be adjusted as a new light source to be adjusted (S305).

Suppose that there are light sources A to E aligned as follows:

A B C D E

When the light source C is selected to be the first light source to be adjusted, the other light sources are then selected sequentially as follows:

B, then D, then A, and finally E or

D, then B, then E, and finally A

When an adjacent light source is selected from the light sources 220 as a new light source to be adjusted (Yes at S306), the process is repeated from S302.

On the other hand, if no light source is present in the light sources 220 that is selectable to be a new light source to be adjusted (No at 5306) or if it is determined at 5304 that the amount of light irradiating the part is sufficient (Yes at S304), the luminance comparing unit 243*e* finds, in the line information assigned to the selected sub-area to be adjusted, another part in which the amount of light is insufficient most seriously (S307).

If any insufficient part is found (Yes at S307), and if any light source is present in the light sources 220 that is allowed to adjust the emission intensity (Yes at S308), the process is repeated from S301. On the other hand, if no part is found in which the amount of light is insufficient most seriously (No at S307), or if any light source is not present in the light sources 220 that is allowed to adjust the emission intensity (No at S308), the increased-amount adjusting process goes to end.

To prevent a problem, such as unevenness in the luminance, it is allowable to adjust the difference between increased amounts of the emission intensities of adjacent light sources of the light sources 220 to a predetermined amount or less.

As described above, the display device 200 according to the second embodiment separates a size-reduced image into a plurality of sub-areas in such a manner that a sub-area farther away from the light sources 220 is wider than a sub-area closer to the light sources 220. The display device 200 then compares, in each of the sub-areas, the luminance values of each pixel in a direction perpendicular to the array direction and selects a pixel having the greatest luminance value, thereby creating line information. After that, the display device 200 compares a light distribution that is a synthesis of the light radiation patterns of all the light sources 220 with a luminance distribution indicated by each line information and then adjusts the emission intensity of each light source. Therefore, even if the light sources are aligned in such a manner that the light radiation patterns overlap with each other, the display device 200 can dynamically decrease the amount of light irradiating a black part included in an image, thereby improving the contrast.

Moreover, because the display device 200 according to the second embodiment not only decreases the number of sub-areas but also creates the line information that contains a collection of pixels included in a sub-area each having the greatest luminance value among the luminance values of pixels being aligned in a direction perpendicular to the array direction of the light sources, the number of pixels to be compared during the emission-intensity adjustment is decreased. Therefore, the contrast is improved, while the amount of calculation is reduced remarkably.

[c] Third Embodiment

The present invention can be embodied variously with some other embodiments than the abovementioned first embodiment and the abovementioned second embodiment.

Some other embodiments of the present invention will be explained below as a third embodiment.

(1) Separation of Size-Reduced Image

Although the area separating unit 243*b* separates a size-reduced image into, for example, the sub-areas 40*a* to 40*d* as illustrated in FIG. 5, an area can be separated in a variable manner. Regarding the decreased-amount adjusting process illustrated in FIG. 11 and the increased-amount adjusting process illustrated in FIG. 12, the number of repetitions of the emission-intensity decreasing process or the emission-intensity increasing process is not fixed; therefore, the area separating unit 243*b* can be configured to decrease the number of the sub-areas of a size-reduced image if the number of repetitions exceeds a threshold.

For example, if the number of repetitions exceeds a threshold, the area separating unit 243*b* changes the number of the sub-areas from four to three and changes the ratio between the widths of the sub-areas to 10:5:2 from the top. The area separating unit 243*b* can be configured to change the number of sub-areas depending on not the number of repetitions but the load on the emission-intensity adjusting unit 243.

Although, in the second embodiment, the light sources are aligned in one line in a lower part of an image, the pattern is not limited thereto. It is scalable easily even if, for example, the light sources are aligned in both an upper row and a lower row. The area separating unit 243*b* sets the number of the sub-areas to six and sets the ratio between the widths of the sub-areas to 2:3:5:5:3:2 from the top so that the widths of the sub-areas that are aligned up and down become symmetrical.

In the above example, the emission-intensity adjusting unit 243 treats a part of the process to which "the downmost sub-area" is subjected as a process to which both "the upmost sub-area and the downmost sub-area" are subjected and then performs the process using the two sub-areas. After that, sub-areas are selected two by two toward the center, line information is created in accordance with the selected sub-areas, and the emission intensity is adjusted in the same manner as in the second embodiment.

If the luminance distribution indicated by the line information goes beyond the light distribution of the emission intensities, the emission-intensity adjusting unit 243 selects, from in total 48 light sources each 24 light sources being aligned in the upper and lower sides, a light source that is closest to a part of a pixel that has a greatest exceeded amount. The emission-intensity adjusting unit 243 then increases the emission intensity of the selected light source.

If, for example, a light source that is closest to a part of a pixel that has the greatest exceeded amount is on the upper side and all the light sources on the upper side have the emission intensity 100%, the emission-intensity adjusting unit 243 selects a light source from the light sources on the lower side and increases the emission intensity of the selected light source.

(2) Comparison Between Luminances

Figure 14:
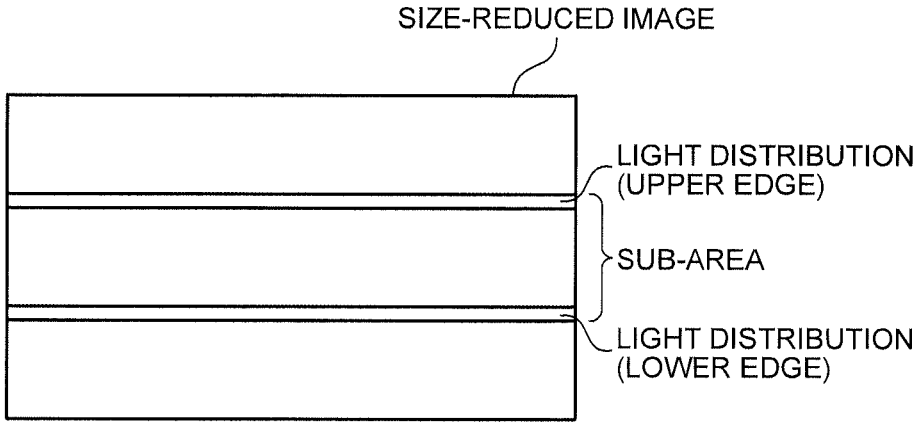
FIG. 14 is a first diagram that explains another process performed by the luminance comparing unit.

Although, in the above example, the luminance comparing unit 243*e* compares the luminance of the light distribution at the middle of the sub-area with the luminance distribution indicated by the line information position by position in the array direction, the configuration is not limited thereto. For example, another example will be explained with reference to FIG. 14. FIG. 14 is a first diagram that explains another process performed by the luminance comparing unit.

As illustrated in FIG. 14, the luminance comparing unit 243*e* compares the light distribution that corresponds to the lower edge of the sub-area with the luminance distribution indicated by the line information. The luminance comparing unit 243*e* further compares the light distribution that corresponds to the upper edge of the sub-area with the luminance distribution indicated by the line information. The adjustment-amount deciding unit 243*g* then adjusts the emission intensity of each of the light sources 220.

With the above configuration, the contrast is improved, while the amount of calculation is reduced and, moreover, each of the light sources 220 is adjusted with the luminance values included in the line information being satisfied. More particularly, each of the upper-edge and the lower-edge light distribution is compared with the line information and each of the light sources 220 is adjusted so that each of the light distribution does not go under the luminance distribution indicated by the line information. Accordingly, an image is displayed with the luminance of the image being satisfied.

Figure 15:
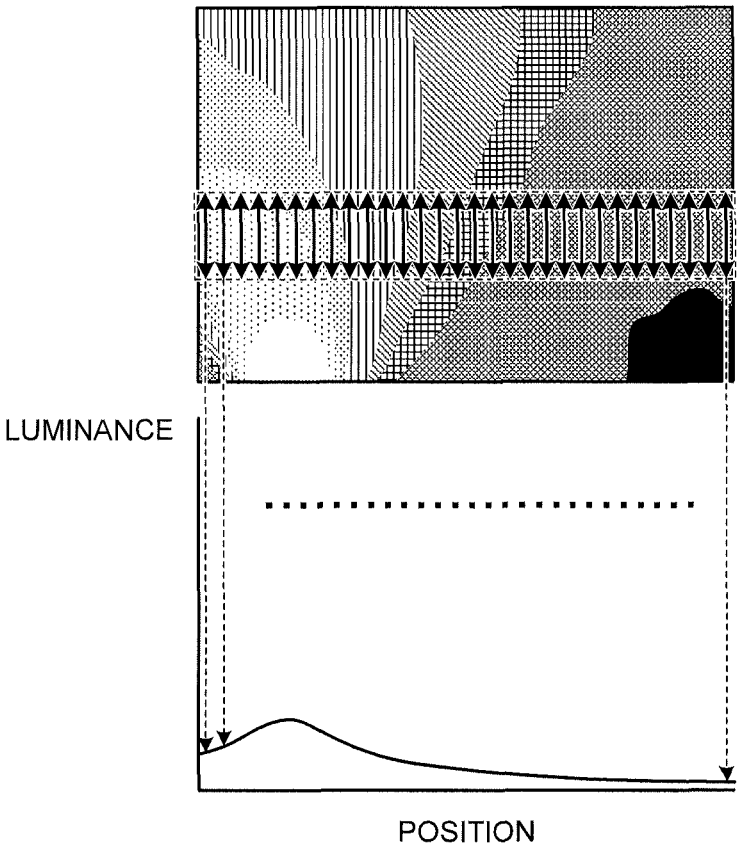
FIG. 15 is a second diagram that explains another process performed by the luminance comparing unit.

Another example of comparing between luminances is explained with reference to FIG. 15. FIG. 15 is a second diagram that explains another process performed by the luminance comparing unit.

As illustrated in FIG. 15, the luminance comparing unit 243*e* can be configured as follows. The luminance comparing unit 243*e* selects, from a light distribution that corresponds to a sub-area, an emission intensity that is the lowest among the emission intensities included in a direction perpendicular to the array direction of a light distribution. The luminance comparing unit 243*e* then compares a light distribution that is a collection of position-based lowest emission intensities with the luminance distribution indicated by the line information and then adjusts the emission intensity of each of the light sources 220.

With the above configuration, the contrast is improved, while the amount of calculation is reduced and, moreover, each of the light sources 220 is adjusted with the luminance values included in the line information being satisfied. More particularly, through the comparing of the light distribution that corresponds to the upper edge and the lower edge of a sub-area, it is possible to adjust each of the light sources 220 so that the light distribution does not go under the luminance distribution indicated by the line information. Accordingly, an image is displayed with the luminance of the image being satisfied.

(3) System Configuration, etc.

The configuration of the display device 200 according to the present embodiment illustrated in FIG. 2 can be changed variously unless departing from the scope of the invention. For example, if the function of the display control device 240 of the display device 200 is implemented as software, when a computer executes the software, the same function, as that of the display control device 240 is realized. An example of a computer will be explained below that executes a display control program, the display control program being software that is implemented to realize the function of the display control device 240.

Figure 16:
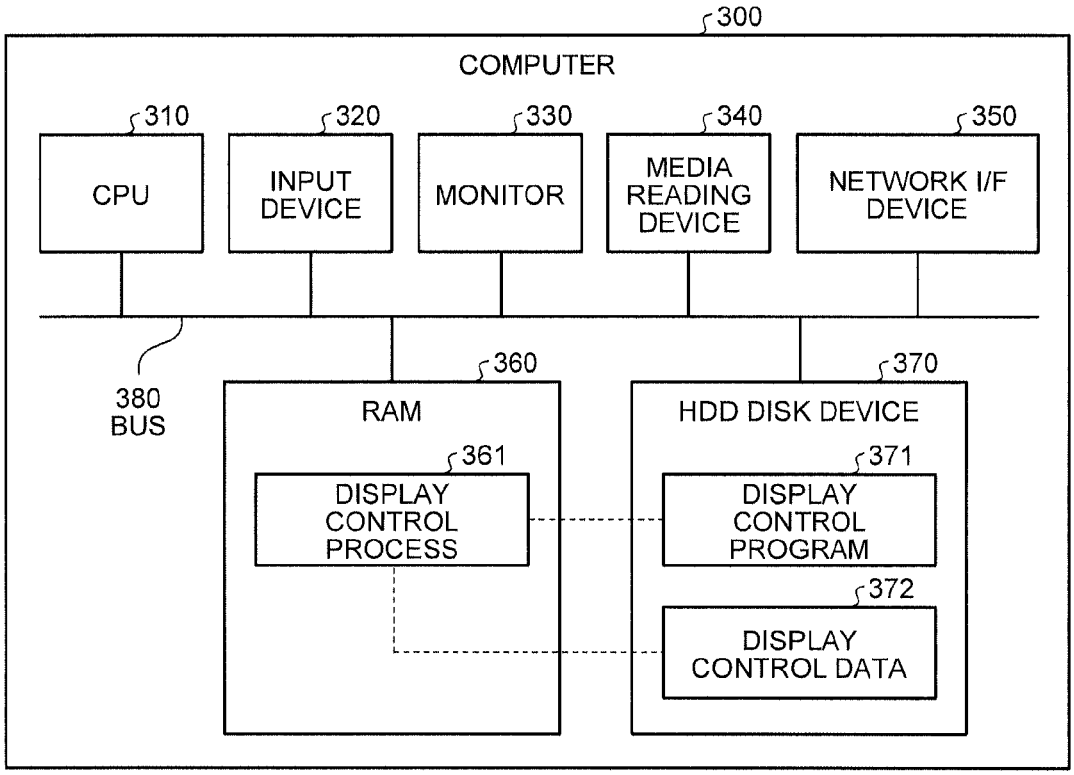
FIG. 16 is a functional block diagram of a computer that executes a display control program.

FIG. 16 is a functional block diagram of a computer that executes the display control program. A computer 300 includes a CPU (Central Processing Unit) 310 that executes various computing processes, an input device 320 that receives data from a user, and a monitor 330 that includes the light control unit 210. The computer 300 is connected to a media reading device 340 that reads programs or the like from a storage medium, a network interface device 350 that transmits/receives data to/from another computer via a network, a RAM (Random Access Memory) 360 that temporarily stores therein various information, and a hard disk device 370. Each of the devices 310 to 370 is connected to a bus 380.

The hard disk device 370 stores therein a display control program 371 that has the same function as the function of the display control device 240 illustrated in FIG. 2 and display control data 372 that corresponds to various data stored in the storage unit 250 illustrated in FIG. 2. The display control data 372 can be decentralized appropriately and a part can be stored in another computer that is connected thereto via a network.

When the CPU 310 reads the display control program 371 from the hard disk device 370 and loads it on the RAM, the display control program 371 operates as a display control process 361. The display control process 361 then appropriately loads information or the like read from the display control data 372 on an area of the RAM 360 that is assigned thereto and performs various data processes using the loaded data, etc.

It is unnecessary to store the display control program 371 in the hard disk device 370. The computer 300 can be configured to read a program from a recording medium, such as a CD-ROM, and executes the program.

According to the above display device, even with a liquid crystal display device that has light sources arranged in a manner that gives production cost advantages, the contrast is increased and the consumed power is reduced.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A display device comprising:

a plurality of light sources that are aligned in an array direction such that areas irradiated by the light sources overlap with each other;

an image display area that includes a plurality of pixels being aligned in a second perpendicular direction being perpendicular to the array direction;

a separating unit that separates the image display area into a plurality of sub-areas with respect to a direction parallel to the array direction;

a comparing unit that compares luminance of each of the plurality of pixels being aligned in the perpendicular direction with respect to each of the sub-areas made by the separating unit and selects a pixel, from each of the sub-areas, having a greatest luminance from among the plurality of pixels compared to create line information; and a control unit that creates line information for the sub-areas based on the pixel selected for each respective sub-area, the line information indicating a luminance distribution by aligning the pixels selected in the array direction, the control unit creating a synthesized light distribution of the light sources by using light radiation patterns of the light sources, the control unit controlling an amount of light from each of the light sources in accordance with a comparison result of the luminance distribution of the created line information and the synthesized light distribution of the light sources.

2. The display device according to claim 1, wherein the separating unit separates the image display area into the sub-areas in such a manner that when a first sub-area is farther away from the light sources than a second sub-area, a width of the first sub-area with respect to the perpendicular direction becomes wider than a width of the second sub-area.

3. The display device according to claim 1, wherein the separating unit changes the number of the sub-areas depending on a processing load.

4. The display device according to claim 1, wherein the synthesized light distribution is a synthesis of minimum values of distributions of light from the light sources.

5. The display device according to claim 1, wherein the control unit controls the amount of light from each of the light sources in accordance with the synthesized light distribution that corresponds to both edges of each of the sub-areas with respect to the perpendicular direction and the line information.

6. A control method performed by a display device that includes a plurality of light sources that are aligned in an array direction such that areas irradiated by the light sources overlap with each other, the control method comprising:

separating an image display area into a plurality of sub-areas with respect to a direction parallel to the array direction, the image display area including a plurality of pixels being aligned in a perpendicular direction being perpendicular to the array direction;

comparing a luminance of each of a plurality of pixels being aligned in a perpendicular direction on the display device with respect to each of the sub-areas separated;

selecting a pixel, from each of the sub-areas, having a greatest luminance from among the plurality of pixels compared in the comparing to create line information;

creating line information for the sub-areas based on the pixel selected for each respective sub-area, the line information indicating a luminance distribution by aligning the pixels selected, in the array direction;

creating a synthesized light distribution of the light sources by using light radiation patterns of the light sources; and controlling an amount of light from each of the light sources in accordance with a comparison result of the luminance distribution of the created line information and the synthesized light distribution of the light sources.

7. A display device comprising:

a plurality of light sources that are aligned in an array direction such that areas irradiated by the light sources overlap with each other;

an image display area that includes a plurality of pixels being aligned in a perpendicular direction being perpendicular to the array direction;

a processor; and a memory, wherein the processor executes:

separating an image display area into a plurality of sub-areas with respect to a direction parallel to the array direction;

comparing a luminance each of the plurality of pixels being aligned in a perpendicular direction with respect to each of the sub-areas separated by the separating;

selecting a pixel, from each of the sub-areas, having a greatest luminance from among the plurality of pixels compared by the comparing to create line information;

creating line information for the sub-areas based on the pixel selected for each respective sub-area, the line information indicating a luminance distribution by aligning the pixels selected, in the array direction;

creating a synthesized light distribution of the light sources by using light radiation patterns of the light sources; and controlling an amount of light from each of the light sources in accordance with a comparison result of the luminance distribution of the created line information and the synthesized light distribution of the light sources.

8. The display device according to claim 1, wherein control unit selects to increase and decrease amount of light from each of the light sources based on the comparison result of a luminance distribution indicated by selected line information with a luminance of the corresponding part of the light distribution of the light sources, controls increase of an emission intensity of selected light source to be adjusted so that the amount of light irradiating becomes sufficient or to increase the emission intensity to one hundred percent, and controls decrease of the emission intensity of a selected light source for maintaining a sufficient amount of light.

* * * * *

UNITED STATES PATENT AND TRADEMARK OFFICE

CERTIFICATE OF CORRECTION

PATENT NO. : 8,760,387 B2
APPLICATION NO. : 13/351720
DATED : June 24, 2014
INVENTOR(S) : Masayoshi Shimizu It is certified that error appears in the above-identified patent and that said Letters Patent is hereby corrected as shown below:

In the Claims

Column 15, Line 41, In Claim 1, before “perpendicular” delete “second”.

Signed and Sealed this
Twenty-eighth Day of October, 2014

Michelle K. Lee

Michelle K. Lee
*Deputy Director of the United States Patent and Trademark Office*